United States Patent [19]

Wickstead

[11] 4,063,643

[45] Dec. 20, 1977

[54] SIZE CONTROL

[75] Inventor: Clifford Wickstead, Greenford, England

[73] Assignee: Rockware Glass Limited, Greenford, England

[21] Appl. No.: 663,709

[22] Filed: Mar. 4, 1976

Related U.S. Application Data

[63] Continuation of Ser. No. 514,555, Oct. 11, 1974, abandoned.

[30] Foreign Application Priority Data

Feb. 18, 1974 United Kingdom ..... 7339/74

[51] Int. Cl.[2] ..... B07C 5/08

[52] U.S. Cl. ..... 209/82; 209/88 R

[58] Field of Search ..... 209/88 R, 80, 73, 82; 33/174 R, 174 P, 174 PA, 143 R, 143 E

[56] References Cited

U.S. PATENT DOCUMENTS

| | | | |
|---|---|---|---|
| 3,032,192 | 5/1962 | Uhlig | 209/88 R |
| 3,080,659 | 3/1963 | Wolford | 209/88 R X |
| 3,278,023 | 10/1966 | Schneider | 209/88 R |
| 3,343,673 | 9/1967 | Thacker et al. | 209/82 X |
| 3,880,000 | 4/1975 | Burns | 73/147 L X |

FOREIGN PATENT DOCUMENTS

| | | | |
|---|---|---|---|
| 553,925 | 6/1943 | United Kingdom | 209/88 R |

*Primary Examiner*—Robert B. Reeves
*Assistant Examiner*—Joseph J. Rolla
*Attorney, Agent, or Firm*—Leydig, Voit, Osann, Mayer & Holt, Ltd.

[57] ABSTRACT

Apparatus is described for checking articles on a conveyor and for removing oversize ones. The articles pass between a fixed feeler and push out a swinging feeler. If the swinging feeler is pushed too far, indicating an oversize article, this is detected and the respective article subsequently removed from the conveyor. The apparatus is particularly for use with glass containers.

4 Claims, 11 Drawing Figures

SIZE CONTROL

Figure 1:
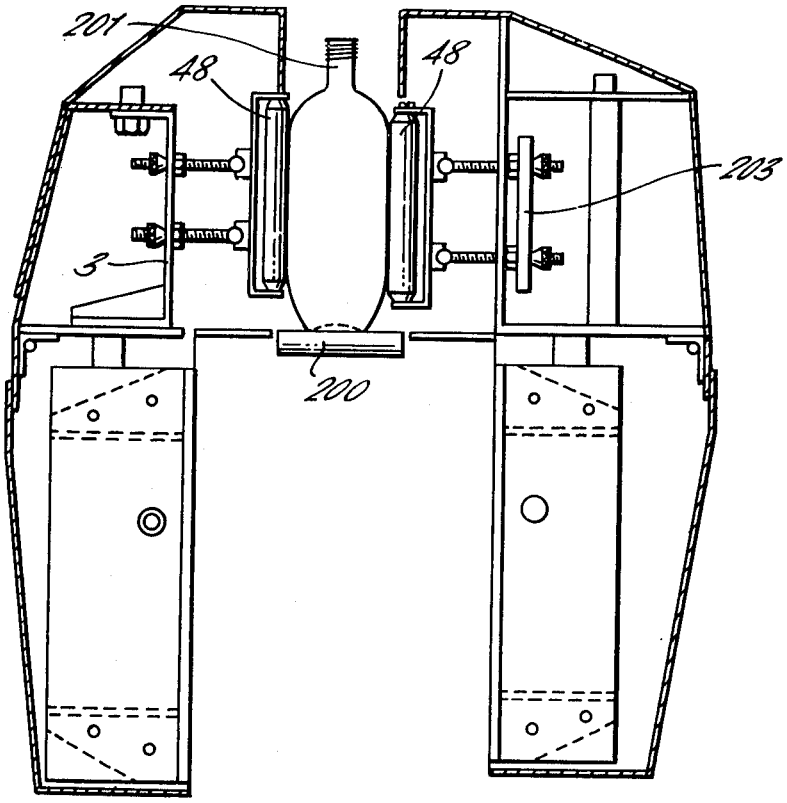

This is a continuation, of application Ser. No. 514,555, filed Oct. 11, 1974, now abandoned.

FIELD OF THE INVENTION

This invention relates to size control. In particular, the application is applicable to checking the sizes of glass bottles being conveyed from a glass bottle manufacturing machine, but it will be appreciated that the invention is of generally wider applicability.

For simplicity, reference will only be made in the following description to the manufacture of glass bottles but it is to be understood that the application relates generally to analogous processes in other fields.

In the manufacture of glass bottles it is important to ensure that the bottles produced are all of the right size. It is particularly important to ensure that no bottle is produced which is over the maximum tolerance size since such a bottle could easily become stuck in subsequent handling machinery, e.g. bottle filling, cleaning or sealing machinery, with extremely disadvantageous results. It is naturally also desirable to eliminate bottles from production which are of less than the minimum size which can be tolerated, though the presence in automatic machinery of slightly undersized bottles does not generally cause very great problems.

In the past, bottles of greater than the allowable size have been eliminated by passing the bottles produced from a bottle making line through a fixed metal gauge, usually of steel, sized to allow all bottles of desired size plus maximum tolerance to pass through, but to stop any bottle of greater size. Such metal gauges do not work satisfactorily since there is a tendency for bottles just too large to lodge tightly in the gauge and to be very difficult to remove therefrom. Normally, the bottle must either be pushed back out of the gauge and discarded (against the flow of incoming bottles) or the bottle must be smashed and the fragments allowed to clear out of the way.

OBJECT OF THE INVENTION

It is an object of the present invention to provide apparatus for size checking suitable, for example, for use in glass bottlemaking lines, which does not suffer from the disadvantages of these known steel gauges.

GENERAL DESCRIPTION OF THE INVENTION

According to the present invention there is provided apparatus for size monitoring which comprises a conveyor adapted to feed articles through a checking station, fixed feeler means at the checking station, swingable feeler means at the station biased towards the fixed feeler means, a detector associated with the swingable feeler means and adapted to detect when the swingable means passes a given point, and means located downstream of the station and adapted, in response to a signal from the detector, to remove an article from the conveyor.

In use of such an apparatus, the articles to be checked are placed on the conveyor and fed between the fixed and swingable feelers. As the articles pass between the feelers, the swingable feeler is swung through a sufficient distance to allow the article to pass. If this distance is greater than a given value (which depends on the maximum tolerance article size) then the detector detects this and, after such an article leaves the gap between the feelers, it is removed from the conveyor.

In order to minimise the risk of jamming, it is preferred to construct the feelers as freely rotatable rollers, made for example of polytetrafluoroethylene. The axes of the rollers should be perpendicular to the direction of travel of the articles.

One feeler is mounted swingably, and this mounting is preferably as light as practical in order to minimise the force necessary to push the articles through the gap between the fixed and swingable feelers. The most preferred mounting is to mount the swingable feeler via a spring plate. By adjustment of the base on which the spring plate is set, the bias on the swingable feeler may be adjusted.

In order to damp out undesired movement of the swingable feeler, it is preferable to provide some damping means associated therewith, for example a liquid filled dashpot device.

The detection of whether the swingable feeler has swung too far, i.e. of whether an impermissibly oversize article is passing through the gap between fixed and swingable feelers, may conveniently be effected by a mechanical microswitch which bears lightly on the swingable feeler. By adjustment of the position of the microswitch, adjustment of the maximum tolerable size is possible. In place of a mechanical microswitch, an electronic displacement detection system may be employed.

In either case, circuitry of standard type is provided in order to convert the signal from microswitch or the like into the action of removal of the article.

In this connection it is preferable to arrange initiation of the article removing sequence as the swingable arm swings back from being in a position over maximum tolerance to being in a position in which the microswitch or the like is not activated. This ensures that the article removing sequence is only brought into operation provided the offending article has left the detection station and is proceeding downstream.

It is naturally also possible to provide, in such apparatus, means for detecting when the swingable arm has not been swung enough by an article, i.e. when the article is impermissibly undersize, and in response thereto, to activate the article removal means.

The article removal means may be of any known type, e.g. a mechanically actuated "knock-off" pin or a blast of air. In either case, a time delay member may be present in the control circuitry in order to allow time for the defective article to pass from emerging from the feelers to the removal point.

SPECIFIC DESCRIPTION OF THE DRAWINGS

Figure 2:
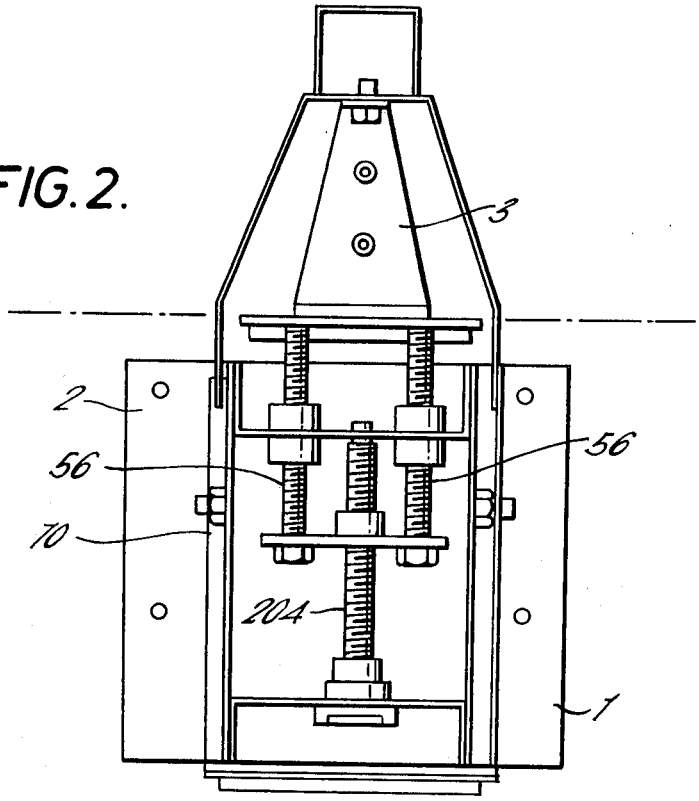
Figure 3:
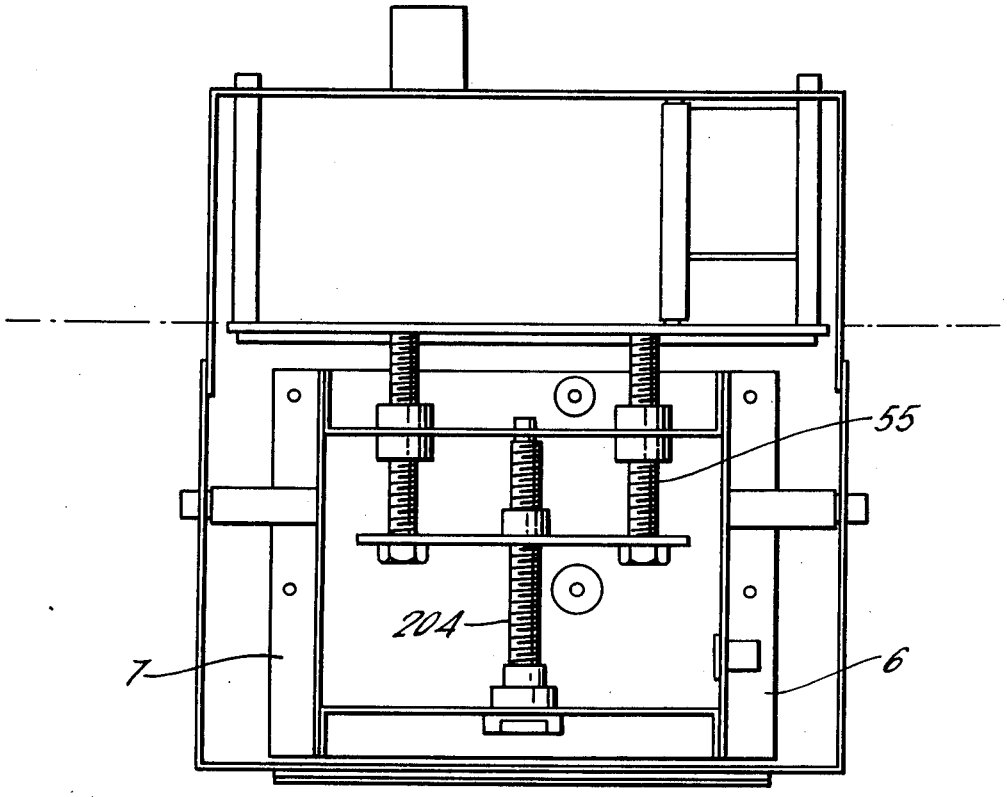
Figure 4:
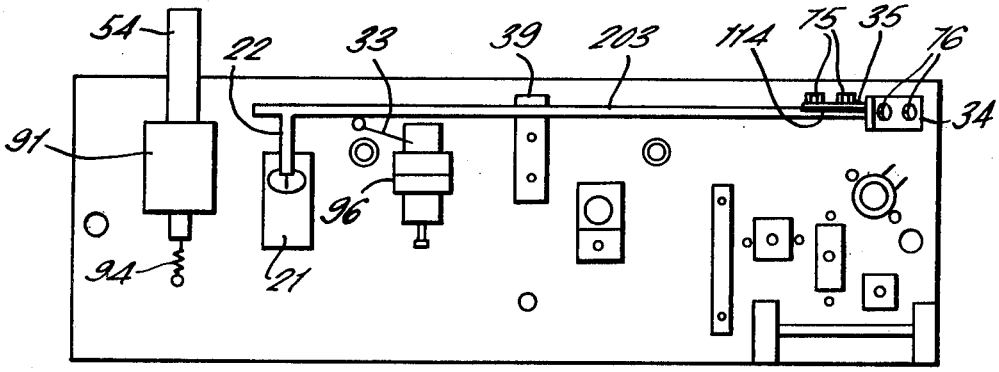
Figure 5:
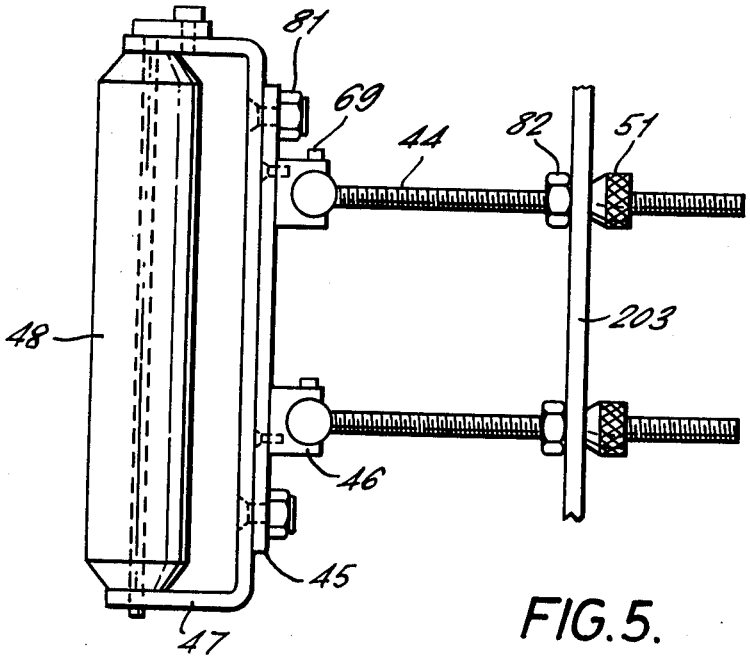
Figure 6:
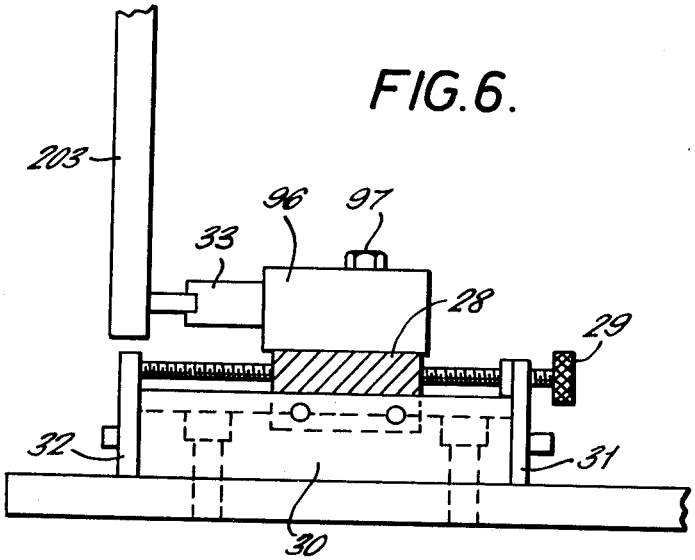
Figure 7:
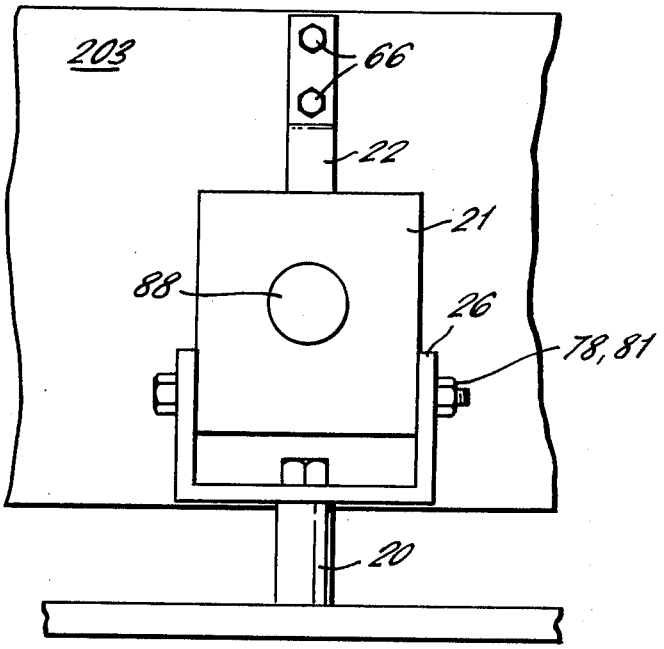
Figure 8:
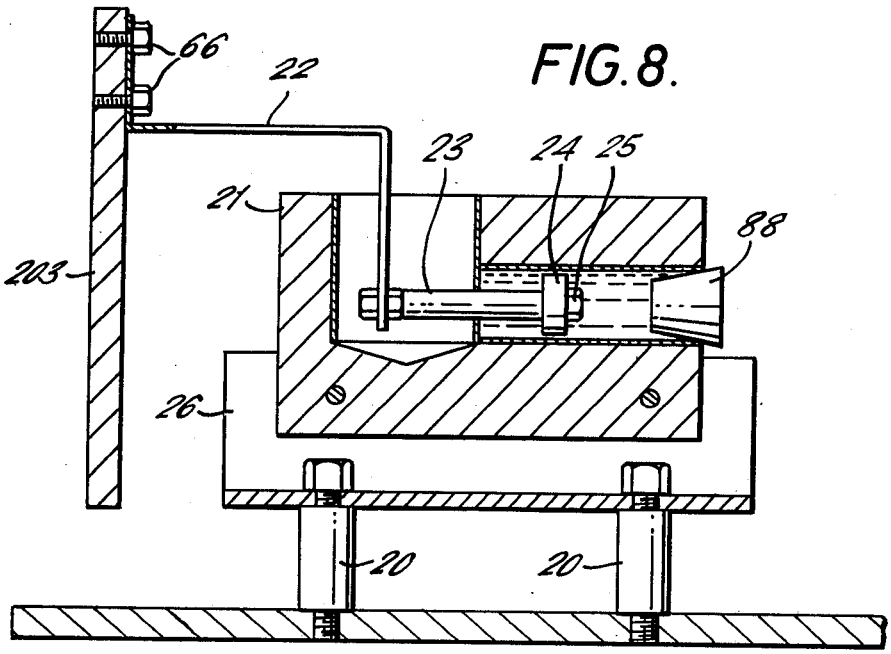
Figure 9:
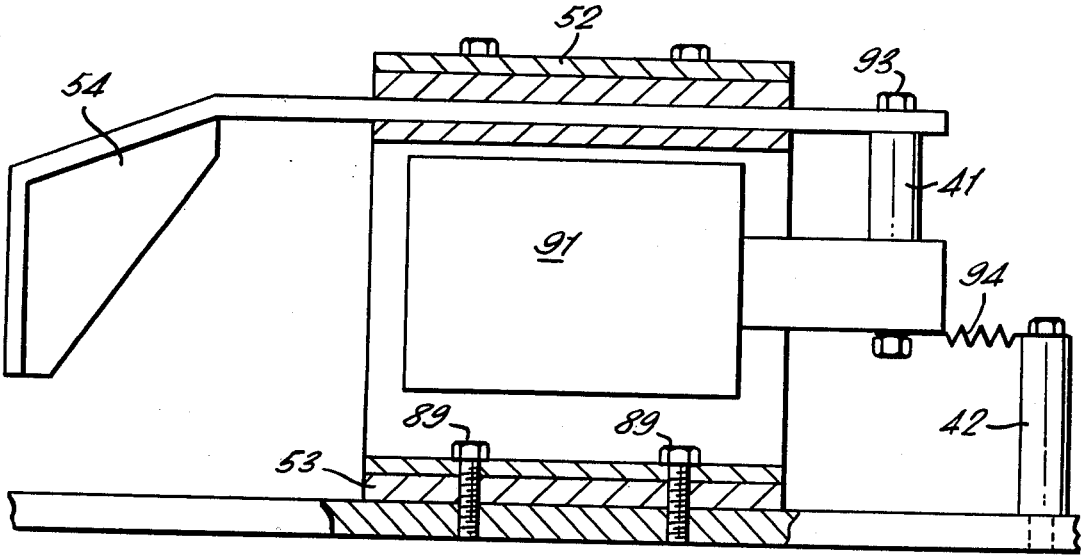
Figure 10:
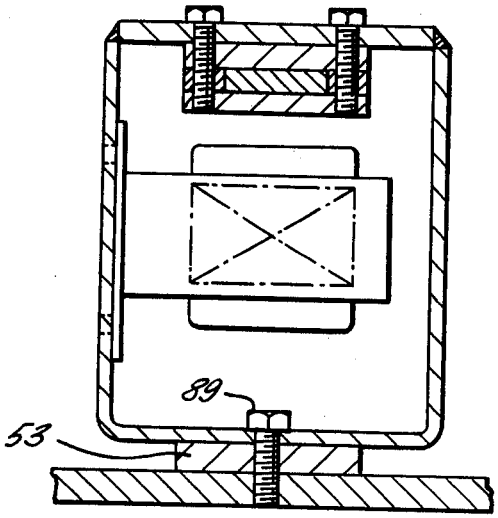
Figure 11:
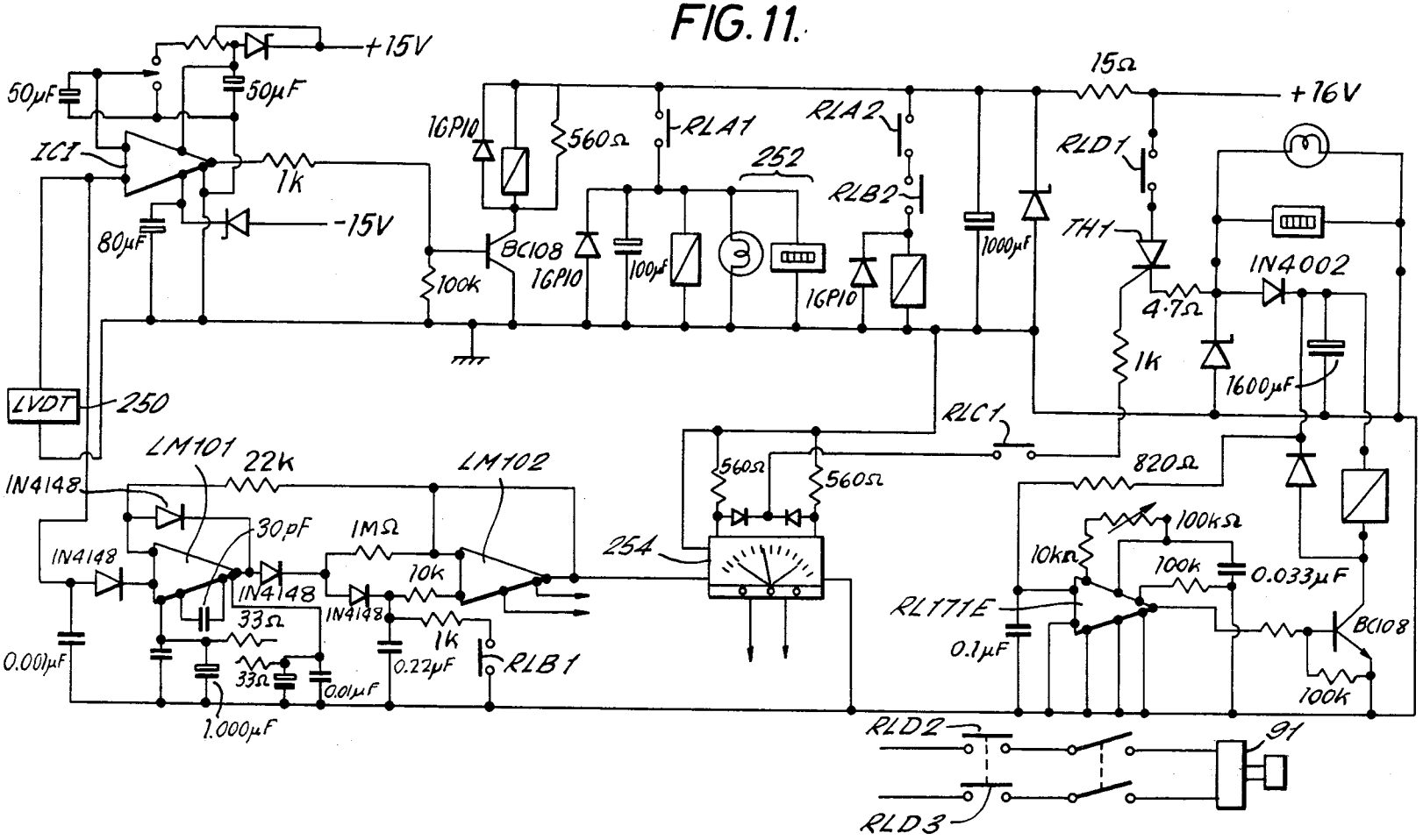

The invention is illustrated by way of example, with reference to a glass bottle checking machine which is diagrammatically shown in the accompanying drawings. In the drawings:

FIG. 1 is a transverse section through the apparatus in use,

FIG. 2 is a side view of the part of the apparatus to the left as seen in FIG. 1, FIG. 3 is a side view of the part of the apparatus to the right as seen in FIG. 1, FIG. 4 is a plan view of the detection and article removal parts of the apparatus, and their associated equipment, FIG. 5 is a detail of a feeler roller assembly, FIG. 6 is a detail of the microswitch assembly, FIG. 7 is an end view of the dashpot assembly, while, FIG. 8 is a side view of the dashpot assembly, FIG. 9 is a side view of the knockoff solenoid assembly and FIG 10 is an end view of the knockoff solenoid assembly FIG. 11 is a circuit diagram for an alternative embodiment in which bottles both too large and too small may be rejected.

Referring first to FIG. 1, this shows a bottle conveyor 200 on which is located a line of bottles 201. The conveyor runs between two units, mounted by means of mounting brackets 1, 2, 6, 7 on the framework of the conveyor (not shown). The left hand side unit (as seen in FIG. 1) comprises a fixed position free-running roller 48 mounted adjustably on a bracket 3. The right hand unit as seen in FIG. 1 comprises a free-running roller 48 mounted adjustably on a swinging plate 203. As also seen in FIG. 1, both rollers 48 are elongated (see also FIG. 5) and they engage the opposite sidewalls of the bottles 201 over substantially their entire height.

The details of the roller mounting are shown in FIG. 5. The distance of the roller 48 from the plate 203 can be varied by screwing nuts 82, 51 along threaded support bars 44, and its inclination varied by the same method, movement being taken up in swivel joints 69, 46, 70. Attached to those joints is a face-plate 45 to which is secured an assembly of roller 48 and bracket 47. This assembly may be changed to match the apparatus to different bottle shapes or sizes by unbolting the assembly at 81. The roller 48 is made of polytetrafluoroethylene and has tapered ends to reduce the bearing surface on the bracket and so make the roller as free-running as possible.

As can be seen most clearly from the plan view in FIG. 4, plate 203 is supported on a bracket 34 via a leaf spring 114. Spring 114 is clamped to bracket 34 and to plate 203 by means of clamping plates 35 and bolts 75. Bracket 34 can pivot about a post 36 and is bolted to the frame of the apparatus and tightened into position by bolt 76. This bracket is used to adjust the rest position and bias on plate 203 in conjunction with a stop 39 which is likewise bolted down on to the frame of the apparatus. Stop 39 just catches on the base of plate 203 and is first adjusted so that, when plate 203 is touching stop 39, the separation between the two rollers 48 is just smaller than the size of the articles to be checked. This ensures that only a small amount of movement of plate 203 takes place during use. Then bracket 34 is turned so as to press plate 203 lightly against stop 39, after which bolt 76 is tightened.

Mounted on the frame of the apparatus and adjacent to plate 203 is a microswitch 96 (see especially FIG. 6). This switch is bolted by a bolt 97 onto a slide plate 28. Slide plate 28 is internally threaded and is mounted on a slide base 30, 31, 32. Mounted between end plates 31, 32 is a threaded shaft which passes through plate 28 and bears a knurled knob 29 at one end for adjustment. With rollers 48 held apart by a bottle of maximum permissible size, knob 29 is adjusted so that the microswitch is just about to make contact. The actuation arm 33 of the microswitch bears a roller at its end which rolls on plate 203.

Movement of plate 203 is damped by a dashpot arrangement mounted on the frame of the apparatus and adjacent the free end of plate 203 (see FIGS. 7 and 8). This consists of mounting posts 20 on which is set a mounting bracket 26 in which is bolted by 78, 81 an open topped dashpot 21. This dashpot has an open aperture and cylinder which is filled with a suitable fluid, e.g. oil. Fluid may be drained by removing a plug 88 which constitutes the end wall of the cylinder. In the cylinder is a loosefitting piston 24 bolted with a rod 23 on to a bracket 22, by means of bolt 25. Bracket 22 is bolted at 66 onto the back of plate 203.

Also mounted on the frame of the apparatus, and downstream with respect to plate 203, is a solenoid 91, which is bolted down by bolts 89 via a shock absorbing packing 53 (see FIGS. 9 and 10). On the end of the solenoid core is a post 41, to which is bolted by bolt 93 a pushoff arm 54, which slides in a mounting 52 on top of the solenoid. Also attached to the end of the solenoid core is a tension spring 94, which is firmly fixed at its other end to a post 42 mounted on the frame of the apparatus.

As can be seen in FIG. 4, a number of other components, chiefly electrical, are also mounted on the apparatus frame; the detailed construction of these is not relevant to the general description of the functioning of the apparatus and is accordingly not discussed further.

In order to enable the apparatus to be adjusted for different bottle sizes, both sides of the apparatus may be adjusted in height by means of threaded pillar supports, as seen in FIGS. 2 and 3 and denoted 204, 55, 56.

In FIGS. 2 and 3 the level of the conveyor belt surface on which the bottles rest is indicated by the horizontal dashed line.

In use, the apparatus is positioned as shown in the drawings and set up as described above. As each bottle passes along on the conveyor, it passes through the gap between the two rollers 48. Banging on these rollers is minimised by the low angle of incidence of the bottle surface on the roller 48 (due to the positioning of stop 39) and plate 203 is damped by the dashpot.

As the plate swings back each time a bottle passes, the actuation arm 33 is moved. If an oversize bottle passes the gap, arm 33 is moved so far back that the microswitch switches. When the roller returns, under the action of leaf spring 114, the microswitch switches back and this second switching actuates, via suitable circuitry, solenoid 91 at an appropriate time so that as the offending bottle passes along on conveyor 200, it is knocked sideways by push-off arm 54, e.g. into a waiting reject basket.

It is found that the apparatus as just described is effective in removing oversize bottles. However, it does not remove bottles which, though oversize, are not outside the specified tolerance, and it does not allow any bottle, even one grossly oversize, to jam in the checking station.

In an alternative embodiment, in which it is desired to remove both bottles too large and bottles too small, i.e. below the minimum tolerable size, the microswitch 96 is replaced by a transducer of known type which gives a voltage output dependent on its position. Such devices are known as linear variable displacement transducers (LVDTs).

FIG. 11 shows diagrammatically a suitable control circuitry, which is connected to an LVDT 250 and which controls, via a relay RLD, a knock-off solenoid 91.

The output from the LVDT is set to be 0 when the moveable roller 48 is in its relaxed position and approximately + 1 volt when the arm is deflected to its maximum extremity.

When the arm 203 deflects, the output from the LVDT is fed into a comparator IC1 which, when the voltage exceeds the reference voltage (set by the level trip potentiometer), allows relay RLA to operate.

This in turn allows relay RLB to pull in through RLAI contacts and records the presence of a bottle on a total ware counter and inspection lamp 252.

RLC is not allowed to energise due to RLA2 normally closed contacts opening before RLB2 contacts close. The voltage from the LVDT continues to rise and the peak detector circuit comprising the integrated circuits LM101 and LM102 comes into action.

The 0.22 uF capacitor is allowed to charge up to the input voltage and this is displayed on the meter. RLB1 contacts are open, therefore the capacitor maintains its charge and even as the voltage from the LVDT falls as the bottle leaves the rollers 48, it continues to give an output to the meter relay 254. This is the maximum voltage from the LVDT, i.e. representing the maximum deflection of the roller 48 and corresponding to the actual size of the bottle which has just passed through the rollers.

Providing the meter needle remains between the two set limits on the meter face, the bottle is of acceptable size and no output obtained from the meter. If the bottle is too large or too small, a positive output would appear on one side of the RLCI contacts as shown.

As the bottle continues out of the rollers, RLA would drop out as the voltage into the comparator became less than the reference voltage.

RLB however, because of the capacitor across it, falls out slightly later and hence RLC is energised through RLA2 and RLB2 contacts.

RLC1 closes, therefore, allowing the silicon controlled rectifier TH1 to conduct by virtue of its gate going positive. RLB and therefore RLC drop out but TH1, by virtue of its characteristics continues to conduct. This puts 12 volts D.C. on to the timer unit (comprising LR171E etc.) and after the appropriate delay (to let the bottle reach the knock off point) set by the 'time to reject' potentiometer, RLD is energised. This operates the kick off through contacts RLD2 and RLD3 and resets TH1. The bottle is thus rejected.

The meter has previously been set to zero again as RLB1 contacts made.

I claim as my invention:

1. An apparatus for size monitoring articles fed through a checking station comprising, in combination conveyer means for solely supporting and carrying articles in spaced apart relation into, through and out of said checking station, a first fixed position feeler means including an elongated roller freely rotatable about its axis which is substantially perpendicular to the direction of travel of articles on the conveyor and positioned to just engage the outer most surface of each article on the conveyor, a second swingable feeler means also including an elongated roller freely rotatable about its axis which is substantially perpendicular to the direction of travel of articles on the conveyor, the second swingable feeler means being mounted on and biased by a spring plate towards the first fixed feeler means by an amount insufficient to arrest an article on the conveyor being carried between the fixed and swingable feeler means, damping means connected to the swingable feeler means for damping oscillations thereof, a detector associated with the second swingable feeler means and adapted to detect when the swingable feeler means passes a given point, and reject means located downstream of the checking station and adjacent the conveyor, said reject means being adapted, in response to a signal from said detector means, to remove an article from the conveyor.

2. Apparatus according to claim 1 including adjustment means enabling the bias on the swingable feeler to be adjusted.

3. Apparatus according to claim 1 wherein the detector adapted to detect when the swingable means passes a given point comprises a micro-switch adapted to bear lightly on the swingable feeler.

4. Apparatus according to claim 1 and including time delay means corresponding to the passage in time between the point at which an article on the conveyor passes said swingable means and the time at which it reaches the reject means.

* * * * *